US010428774B2

(12) United States Patent
Bandy et al.

(10) Patent No.: US 10,428,774 B2
(45) Date of Patent: Oct. 1, 2019

(54) SYSTEMS FOR FUEL PUMP ADAPTERS AND METHODS OF USING THE SAME

(71) Applicant: Cummins Inc., Columbus, IN (US)

(72) Inventors: Bryan C. Bandy, Columbus, IN (US); Darrin Ferry, Columbus, IN (US); Gregory J. Mitchum, Franklin, IN (US)

(73) Assignee: Cummins Inc., Columbus, IN (US)

( * ) Notice: Subject to any disclaimer, the term of this patent is extended or adjusted under 35 U.S.C. 154(b) by 174 days.

(21) Appl. No.: 15/377,259

(22) Filed: Dec. 13, 2016

(65) Prior Publication Data

US 2017/0167454 A1 Jun. 15, 2017

Related U.S. Application Data

(60) Provisional application No. 62/266,777, filed on Dec. 14, 2015.

(51) Int. Cl.
*F02M 37/06* (2006.01)
*F02M 37/00* (2006.01)

(52) U.S. Cl.
CPC ..... *F02M 37/06* (2013.01); *F02M 37/0017* (2013.01)

(58) Field of Classification Search
CPC .... F02M 37/06; F02M 37/0017; F02M 39/02; F02M 59/02; F02M 59/102; F02M 59/44; F02M 59/48; F04B 1/0448; F04B 17/05
See application file for complete search history.

(56) References Cited

U.S. PATENT DOCUMENTS 3,279,835 A * 10/1966 Krohm ..... F16B 7/0413 403/326
4,298,319 A 11/1981 Glidden
5,613,476 A * 3/1997 Oi ..... B01D 35/0273 123/509
5,761,959 A * 6/1998 Winter ..... B60K 17/28 74/15.66
5,908,195 A * 6/1999 Sharrer ..... F16J 15/4474 277/348
6,485,022 B1 * 11/2002 Fedorovich ..... F16J 15/4474 277/303
2007/0264132 A1 11/2007 Van Norman et al.
2014/0308150 A1 10/2014 Furrer
2017/0037912 A1 * 2/2017 Bower ..... F16D 11/14

FOREIGN PATENT DOCUMENTS

WO WO 2017016787 A1 * 2/2017 ..... F02M 39/02

* cited by examiner

*Primary Examiner* — Joseph J Dallo
*Assistant Examiner* — Kurt Philip Liethen
(74) *Attorney, Agent, or Firm* — Foley & Lardner LLP

(57) ABSTRACT

A fuel pump includes a body portion housing a fuel pump assembly configured to receive a rotational input and generate fuel flows, a drive shaft extending into the body portion with a pump gear coupled to the drive shaft, and a pilot portion annularly disposed about the drive shaft adjacent to the body portion. A fuel pump adapter is removably and annularly disposed about the pilot portion and configured to engage a gear housing within a fuel pump aperture.

20 Claims, 4 Drawing Sheets

SYSTEMS FOR FUEL PUMP ADAPTERS AND METHODS OF USING THE SAME

CROSS-REFERENCE TO RELATED PATENT APPLICATIONS

This application claims the benefit of and priority to U.S. Provisional Patent Application No. 62/266,777, filed Dec. 14, 2015, the entire disclosure of which is incorporated by reference herein.

TECHNICAL FIELD

The present disclosure relates to internal combustion engines with high pressure fuel pumps.

BACKGROUND

Various features and devices associated with internal combustion engines, such as high pressure fuel pumps, are driven by applied rotational forces. Timing and frequency of the operation of a given fuel pump may be determined by an associated accessory drivetrain that operatively couples various functionalities to the rotational output of an internal combustion engine. Servicing a fuel pump typically includes time and labor intensive procedures to properly remove and replace the fuel pump.

SUMMARY

One embodiment relates to a fuel pump. The fuel pump includes a body portion housing a fuel pump assembly configured to receive a rotational input and generate fuel flows. The fuel pump further includes a drive shaft extending into the body portion and operatively coupled to the fuel pump assembly. The fuel pump includes a pump gear coupled to the drive shaft and configured to translate a rotational force received from an accessory drivetrain into the rotational input received at the fuel pump assembly. The fuel pump also includes a pilot portion annularly disposed about the drive shaft adjacent to the body portion and allowing the drive shaft to rotate within. The fuel pump includes a fuel pump adapter removably and annularly disposed about the pilot portion and configured to engage a gear housing within a fuel pump aperture.

Another embodiment relates to a fuel pump adapter. The fuel pump adapter includes an outer surface formed to removably engage an inner circumference of a gear housing within a fuel pump aperture. The fuel pump adapter also includes an inner surface defining a central aperture concentric to the outer surface, the inner surface formed to removably engage a pilot portion of a fuel pump.

Another embodiment relates to a fuel pump. The fuel pump includes a body portion housing a fuel pump assembly that is configured to generate fuel flows. The fuel pump also includes a drive shaft that extends into the body portion and that is operatively coupled to the fuel pump assembly. The fuel pump also includes a pilot portion that is annularly disposed about the drive shaft adjacent to the body portion and that allows the drive shaft to rotate within. The pilot portion is configured to removably receive a fuel pump adapter for engaging a gear housing.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

BRIEF DESCRIPTION OF THE DRAWINGS

The skilled artisan will understand that the drawings primarily are for illustrative purposes and are not intended to limit the scope of the subject matter described herein. The drawings are not necessarily to scale; in some instances, various aspects of the subject matter disclosed herein may be shown exaggerated or enlarged in the drawings to facilitate an understanding of different features.

The features and advantages of the inventive concepts disclosed herein will become more apparent from the detailed description set forth below when taken in conjunction with the drawings.

DETAILED DESCRIPTION

Following are detailed descriptions of various concepts related to, and embodiments of, adapters for driven devices and methods of installing and removing driven devices on internal combustion engines, according to embodiments of the present disclosure. Although the discussion below includes descriptions of such concepts with respect to fuel pumps, it should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Figure 1:
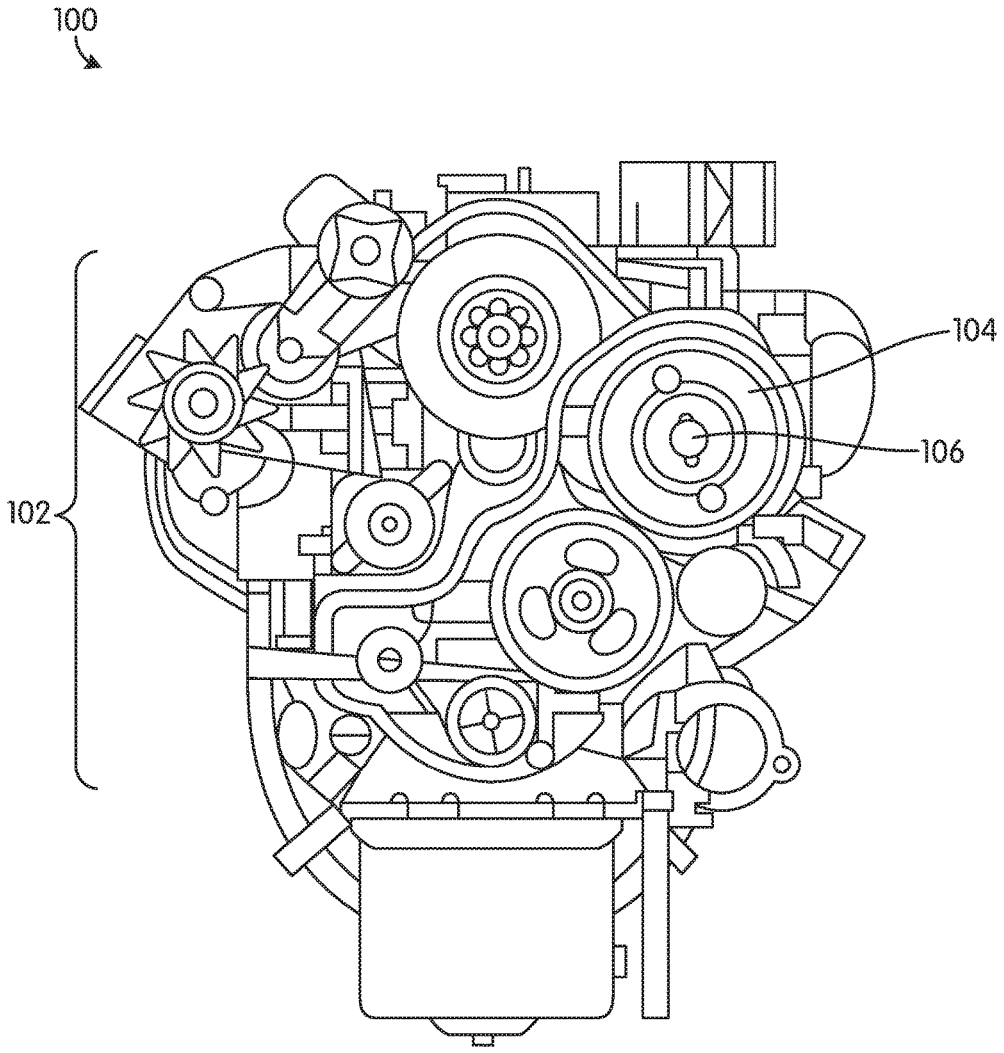
FIG. 1 shows a frontal view of an engine with front accessory drivetrain, according to an example embodiment.

In FIG. 1, an engine 100 is configured to cyclically collect and ignite controlled volumes of air and fuel (e.g., gasoline, diesel, natural gas, and so on) to generate a mechanical force. The mechanical force may be generated as a rotational output, which may be provided, for example, through one or more drive shafts. The engine 100 includes an accessory drivetrain operatively coupled to at least one of the drive shafts, through which the mechanical force of the engine 100 is provided to the accessory drivetrain. In one or more embodiments, such as the embodiment illustrated in FIG. 1, the engine 100 includes a front accessory drivetrain 102. In other embodiments, the engine 100 includes a rear-facing accessory drivetrain.

The front accessory drivetrain 102 may include a plurality of interconnected gears, belts, and/or chains configured to communicate the rotational output of the engine 100 to a plurality of accessory devices. A rotating member of the front accessory drivetrain 102 may be configured to translate the rotational output of the engine 100 by a specific ratio corresponding to a configuration of a specific accessory device. For example, in the embodiment illustrated in FIG. 1, the front accessory drivetrain 102 includes a fuel pump gear 104 translating a first rate of rotation (e.g., rotations per minute, or RPM) corresponding to the rotational output of the engine 100 to a second rate of rotation appropriate for the operation of a fuel pump. The rotation of the fuel pump gear 104 may be communicated to the fuel pump via a concentric pump drive shaft 106 disposed at a center point of the fuel pump gear 104.

Figure 2:
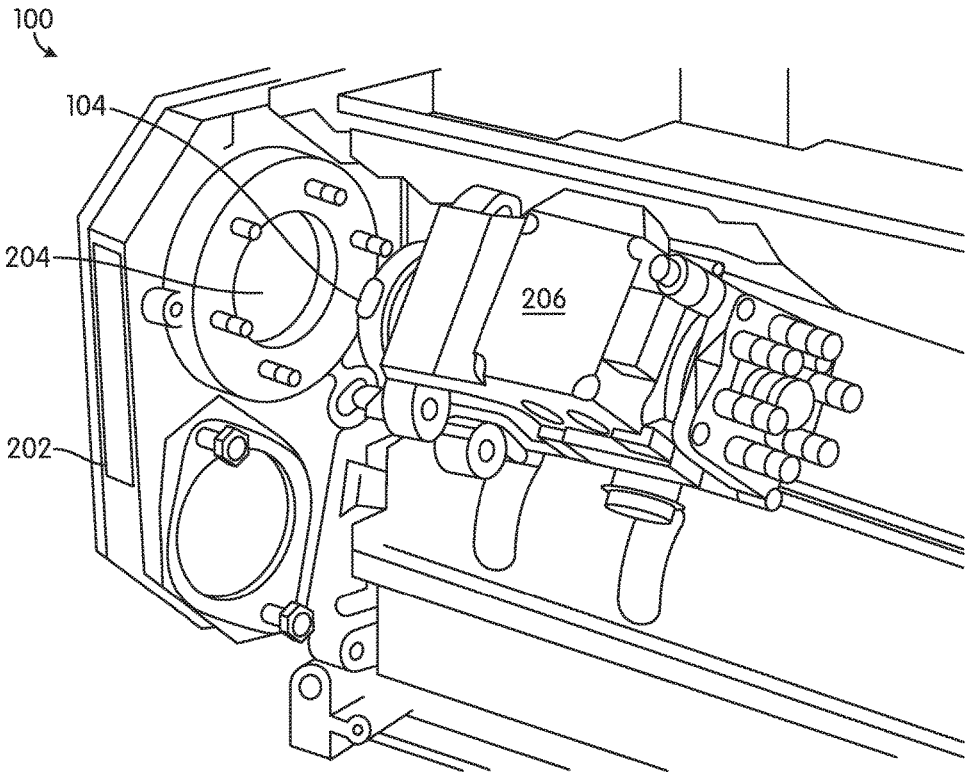
FIG. 2 is a perspective view of a portion of the engine shown in FIG. 1, including a fuel pump.

Referring to FIG. 2, an exploded perspective view of a portion of the engine 100 is provided. At least some of the moving components of the front accessory drivetrain 102 are contained in an open gear housing 202 (e.g., with exposed drivetrain components, for example as shown in FIG. 1). In other arrangements, the gear housing 202 may be enclosed (e.g., via a housing cover surrounding the drivetrain components). In some arrangements, the gear housing 202 provides a mounting point for various components of the front accessory drivetrain 102. The gear housing 202 may also define a space or cavity in which interconnecting components of the front accessory drivetrain 102 (e.g., gears, belts, chains, etc.) may operate.

The gear housing 202 includes a first side facing the front accessory drivetrain 102 and a second side facing away from the front accessory drivetrain. In some arrangements, the gear housing 202 includes a fuel pump aperture 204 through which certain components of an installed fuel pump 206 may be disposed. The fuel pump aperture 204 may be sized, for example, to allow the fuel pump gear 104 to be disposed through the fuel pump aperture 204 and out of the first side of the gear housing 202 (e.g., adjacent to where the front accessory drivetrain 102 is positioned), while a remaining or body portion 207 of the fuel pump 206 is disposed at the second side of the gear housing 202. The gear housing 202 may define the fuel pump aperture 204 to include a wall portion extending across the distance between the first side and the second side. The wall portion may include a positioning portion formed to engage and position the fuel pump 206 and a corresponding adapter while disposed through the fuel pump aperture.

The fuel pump 206 includes a housing and a fuel pump assembly configured to translate a rotational input (e.g., as provided by the pump drive shaft 106 via the fuel pump gear 104) into fuel flows to be delivered to cylinders in the engine 100. In some arrangements, the fuel pump 206 may be configured to provide defined volumes of fuel to specific cylinders in accordance with a timing system operatively coupled to the pump drive shaft 106. For example, the fuel pump 206 may be configured to provide a predetermined number of defined fuel volumes per rotation of the pump drive shaft 106. As such, with the engagement of the fuel pump gear 104 to the front accessory drivetrain 102, the fuel pump 206 may deliver fuel to the engine 100 at rates that correspond to the rotational output of the engine 100.

Figure 3:
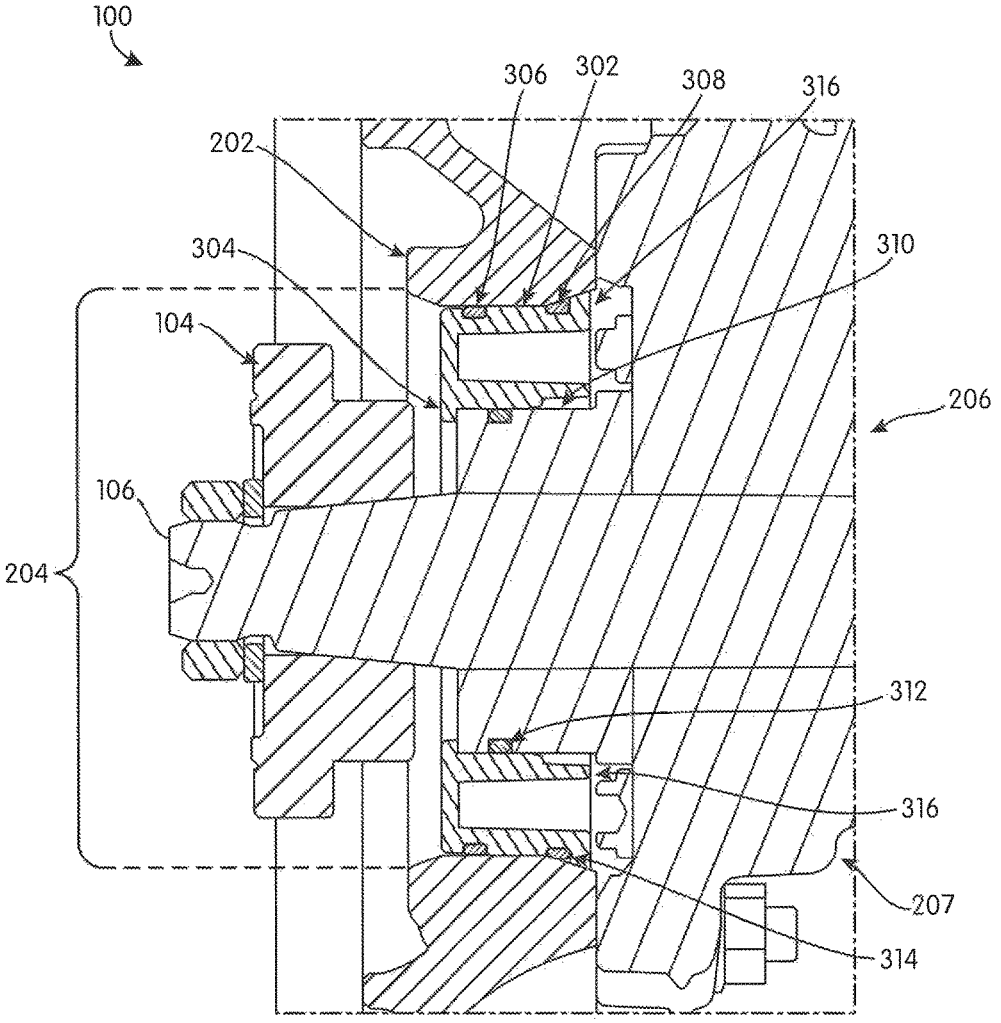
FIG. 3 is a schematic, cross-sectional side view of an installed fuel pump, according to an example embodiment.

FIG. 3 is a longitudinal cross section of a portion of the fuel pump 206 and a portion of the gear housing 202, showing an installation with a fuel pump adapter 302. The fuel pump 206 includes a pilot portion 310 annularly disposed about a base section of the pump drive shaft 106 adjacent to the body portion 207 of the fuel pump 206. The pilot portion 310 is a mounting component configured to properly orient the pump drive shaft 106 in the front accessory drivetrain 102. The pilot portion 310 is a stationary housing component that allows the concentrically-disposed pump drive shaft 106 to rotate within. In some arrangements, the pilot portion 310 includes an annularly-disposed pilot O-ring 312 that is exposed to an interface between the pilot portion 310 and the pump adapter 302. The pilot O-ring 312 may be configured to provide a seal between an outer surface of the pilot portion 310 and an inner surface of the fuel pump adapter 302, and/or the pilot O-ring 312 may provide for reduced vibration and chatter during operation of the engine. The pilot O-ring 312 may be formed of any of a variety of elastic or pliable materials, including, for example, rubber compounds, soft and/or elastic metals (e.g., spring steel), fiber-based materials, or a combination thereof.

The fuel pump adapter 302 is configured to serve as an intermediate mounting device between an inner surface of the gear housing 202 at the fuel pump aperture 204 and the outer surface of the pilot portion 310 of the fuel pump 206. In some arrangements, the fuel pump gear 104 is properly oriented in the front accessory drivetrain 102 when the fuel pump adapter 302 is concentrically coupled to the gear housing 202 at the fuel pump aperture 204 and annularly disposed about the pilot portion 310 of the fuel pump 206. The fuel pump aperture 204 is sized to allow the fuel pump gear 104 to pass through. In such arrangements, both an outer diameter of the fuel pump adapter 302 and an inner diameter of the fuel pump aperture 204 are greater than an outer diameter of the fuel pump gear 104. The fuel pump 206 may therefore be removed from a back side (i.e., the second side) of the gear housing 202, and the pump drive shaft 106 and the fuel pump gear 104 may be withdrawn through fuel pump aperture 204. In turn, the fuel pump 206 may be installed in reverse order. Alternatively, in some arrangements, the fuel pump gear 104 may be coupled to the pump drive shaft 106 from a front side (i.e., the first side) of the gear housing 202 after the fuel pump 206 and the fuel pump adapter 302 are installed from the back of the gear housing 202.

The fuel pump adapter 302 includes a step 304, a sealing O-ring 306, a vibration O-ring 308, and a chamfer 314. The step 304 is a physical feature configured to catch and engage a leading edge of the pilot portion 310 of the fuel pump 206 as the pilot portion 310 is disposed into and through the fuel pump adapter 302. In some arrangements, the step 304 includes one or more protrusions extending toward a center axis at a first end (i.e., disposed toward the front accessory drivetrain 102) of the fuel pump adapter 302, sufficient to narrow a pilot portion 310 receiving aperture to less than a circumference of the pilot portion 310.

The sealing O-ring 306 and the vibration O-ring 308 are annularly disposed about respective outer circumferences of the fuel pump adapter 302. In some arrangements, the sealing O-ring 306 and the vibration O-ring 308 are configured to serve separate roles. For example, the sealing O-ring 306 may be formed from materials selected to provide a fluid seal at an interface portion between the fuel pump adapter 302 and the gear housing 202. As such, the sealing O-ring 306 may be configured to inhibit fluid flow between the fuel pump adapter 302 and the gear housing 202. In turn, the vibration O-ring 308 may be formed from materials selected to dampen vibrations between the fuel pump adapter 302 and the gear housing 202. In other arrangements, each of the sealing O-ring 306 and the vibration O-ring 308 are configured to serve a same role (e.g., to provide a fluid seal and/or to dampen vibration between components).

The chamfer 314 is a flared outer portion at a second end of the fuel pump adapter 302 (i.e., disposed away from the front accessory drivetrain 102). The chamfer 314 may be formed to complement a funnel-shaped portion of the gear housing 202 around the fuel pump aperture 204. In addition, the vibration O-ring 308 may be annularly disposed about the chamfer 314. The chamfer 314 may also be formed such that, when the vibration O-ring 308 is engaged with the gear housing 202, the second end of the fuel pump adapter 302 is disposed within the fuel pump aperture 204. In addition, in this arrangement, the fuel pump adapter 302 is sized to allow for a gap 316 between the second end of the fuel pump adapter 302 and the body portion 207 of the fuel pump 206.

In operation, the fuel pump adapter 302 may be translated into and through the fuel pump aperture 204 until the chamfer 314 causes the vibration O-ring 308 to contact and engage the funnel-shaped portion of the gear housing 202. Engaging at least the vibration O-ring 308 to the funnel-shaped portion of the gear housing 202 may inhibit chatter and contact abrasion between the pump adapter 302 and the gear housing 202. The gap 316 allows the body portion 207 of the fuel pump 206 to engage the gear housing 202 instead of the fuel pump adapter 302.

Referring to FIGS. 2 and 3 generally, the fuel pump 206 is installed in the engine 100 using the fuel pump adapter 302. In one arrangement, an operator may dispose the pump drive shaft 106 through the center aperture of the fuel pump adapter 302 until the leading edge of the pilot portion 310 catches the step 304. The operator may then couple the fuel pump gear 104 to the end of the pump drive shaft 106. The operator may dispose the end of the pump drive shaft 106, the fuel pump gear 104, and then the fuel pump adapter 302 (i.e., having a portion of the pilot portion 310 concentrically disposed therein) through the fuel pump aperture 204. The engagement of the vibration O-ring 308 on the chamfer 314 to the funnel-shaped portion of the gear housing 202 may arrest the translation of the fuel pump adapter 302 through the fuel pump aperture 204 and provide for the gap 316. The engagement of the outer circumference of the fuel pump adapter 302 to the positioning portion of the wall portion at the fuel pump aperture 204 properly aligns the fuel pump gear 104 within the front accessory drivetrain 102. As such, alignment and installation of the fuel pump 206 may be accomplished without having to access or otherwise dismantle other components of the front accessory drivetrain 102. The body portion 207 of the fuel pump 206 may then be in contact with the gear housing 202 about the fuel pump aperture 204, and the operator may fasten the fuel pump 206 to the gear housing 202 (e.g., via a plurality of bolts). In turn, the fuel pump 206 may be removed in a similar manner without disturbing other components of the front accessory drivetrain 102 (e.g., via unfastening the fuel pump 206 from the gear housing 202, and withdrawing the fuel pump adapter 302, the fuel pump gear 104, and the pump drive shaft 106 out of the fuel pump aperture 204).

Figure 4A:
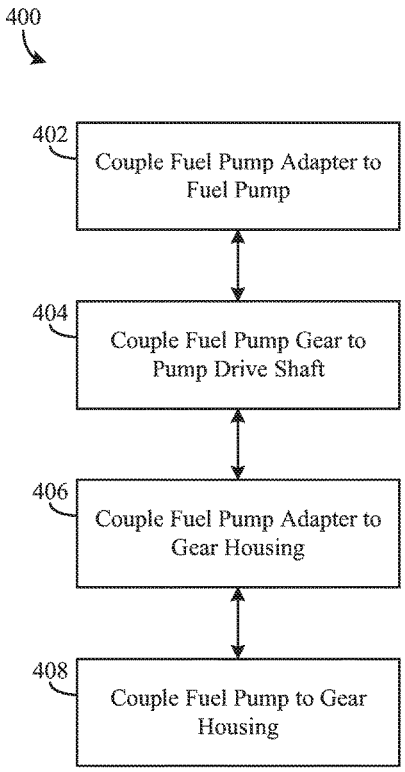
FIGS. 4A and 4B are block flow diagrams of methods of installing and removing a fuel pump, according to example embodiments.

FIG. 4A illustrates a flow diagram showing a method 400 of installing a fuel pump (e.g., the fuel pump 206) with a fuel pump adapter (e.g., the fuel pump adapter 302) in accordance with the present disclosure. In particular arrangements, the fuel pump may be communicatively coupled to an accessory drivetrain (e.g., the front accessory drivetrain 102) without disturbing other components of the accessory drivetrain.

At 402, the fuel pump adapter is coupled to the fuel pump. The fuel pump adapter may be coupled to the fuel pump by disposing a pump drive shaft (e.g., the pump drive shaft 106) through a center aperture of the fuel pump adapter until a step (e.g., the step 304) of the fuel pump adapter catches a leading edge of a pilot portion (e.g., the pilot portion 310) of the fuel pump.

At 404, a fuel pump gear (e.g., the fuel pump gear 104) is coupled to the pump drive shaft. The fuel pump gear may be coupled to an end of the pump drive shaft that is to be communicatively coupled to an accessory drivetrain (e.g., the front accessory drivetrain 102).

At 406, the fuel pump adapter is coupled to a gear housing (e.g., the gear housing 202). The pump drive shaft, the fuel pump gear, and the fuel pump adapter may be disposed through a fuel pump aperture (e.g., the fuel pump aperture 204) of the gear housing. One or more O-rings (e.g., the vibration O-ring 308) annularly disposed about a chamfer (e.g., the chamfer 314) on the fuel pump adapter may engage a complementary funnel-shaped portion of the gear housing to arrest the translation of the fuel pump through the fuel pump aperture. As such, the engagement of the step to the pilot portion and the engagement of an O-ring to the gear housing secures the fuel pump adapter in position in the fuel pump aperture. While in position, the engagement of a positioning portion of a wall portion of the fuel pump aperture to an outer circumference of the fuel pump adapter properly positions the fuel pump gear within the accessory drivetrain. In addition, a gap (e.g., the gap 316) remains between the fuel pump adapter and a body portion 207 of the fuel pump prevents the body portion of the fuel pump from engaging the fuel pump adapter.

At 408, the fuel pump is coupled to the gear housing. The fuel pump may be fastened to a side of the gear housing disposed away from the accessory drivetrain. For example, the fuel pump may be bolted to the gear housing.

Figure 4B:
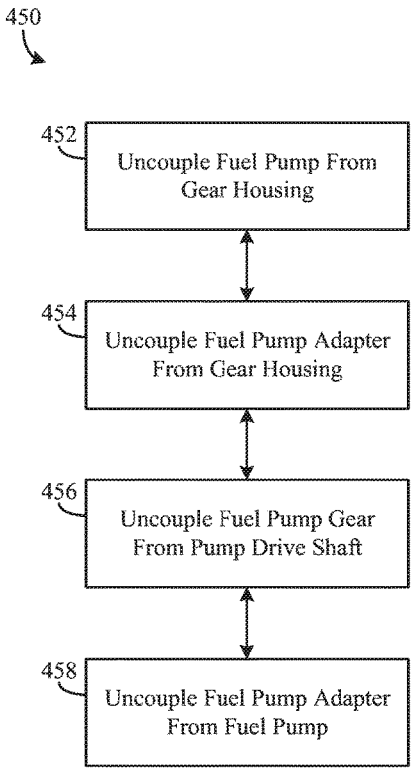

In turn, the fuel pump may be removed by performing the method 400 in reverse order, as illustrated by the method 450 in FIG. 4B. For example, the fuel pump may be uncoupled from the gear housing (at 452), and the fuel pump adapter, fuel pump gear, and pump drive shaft may be uncoupled from the gear housing and withdrawn through the fuel pump aperture (at 454). The fuel pump gear may be decoupled from the pump drive shaft (at 456) and the fuel pump adapter may be uncoupled from the fuel pump (at 458).

For the purpose of this disclosure, the term "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various elements may differ according to other exemplary embodiments, and that such variations are intended to be encompassed by the present disclosure. It is recognized that features of the disclosed embodiments can be incorporated into other disclosed embodiments.

It is important to note that the constructions and arrangements of apparatuses or the components thereof as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

While various inventive embodiments have been described and illustrated herein, those of ordinary skill in the art will readily envision a variety of other mechanisms and/or structures for performing the function and/or obtaining the results and/or one or more of the advantages described herein, and each of such variations and/or modifications is deemed to be within the scope of the inventive embodiments described herein. More generally, those skilled in the art will readily appreciate that, unless otherwise noted, any parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, the technology described herein may be embodied as a method, of which at least one example has been provided. The acts performed as part of the method may be ordered in any suitable way unless otherwise specifically noted. Accordingly, embodiments may be constructed in which acts are performed in an order different than illustrated, which may include performing some acts simultaneously, even though shown as sequential acts in illustrative embodiments.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

What is claimed is:

1. A fuel pump comprising:

a body portion housing a fuel pump assembly configured to receive a rotational input and generate fuel flows;

a drive shaft extending into the body portion and operatively coupled to the fuel pump assembly;

a pump gear coupled to the drive shaft and configured to translate a rotational force received from an accessory drivetrain into the rotational input received at the fuel pump assembly;

a pilot portion annularly disposed about the drive shaft adjacent to the body portion and configured to facilitate rotation of the drive shaft within the pilot portion; and a fuel pump adapter removably and annularly disposed about the pilot portion and configured to engage a gear housing within a fuel pump aperture;

wherein the body portion contacts the gear housing about the fuel pump aperture when the fuel pump adapter is disposed about the pilot portion and engaged with the gear housing within the fuel pump aperture;

wherein the fuel pump adapter includes a step disposed in a control aperture, the step configured to catch a leading edge of the pilot portion; and wherein the fuel pump adapter is configured to remain substantially stationary during rotation of the drive shaft within the pilot portion.

2. The fuel pump of claim 1, wherein an outer circumference of the fuel pump adapter includes a sealing O-ring.

3. The fuel pump of claim 1, wherein an outer circumference of the fuel pump adapter includes a vibration O-ring.

4. The fuel pump of claim 3, wherein the outer circumference of the fuel pump adapter includes a chamfer, and wherein the vibration O-ring is annularly disposed about the chamfer.

5. The fuel pump of claim 4, wherein the chamfer is configured to interface with the gear housing to limit engagement of the fuel pump adapter within the fuel pump aperture.

6. The fuel pump of claim 1, wherein an outer circumference of the fuel pump adapter includes each of a sealing O-ring and a vibration O-ring.

7. The fuel pump of claim 1, wherein the fuel pump adapter is defined by a first diameter and the pump gear is defined by a second diameter, and wherein the first diameter is greater than the second diameter.

8. The fuel pump of claim 1, wherein the body portion is configured to interface with the gear housing;

wherein an outer circumference of the fuel pump adapter comprises a chamfer; and wherein the fuel pump aperture comprises a funnel-shaped portion proximate the interface between the body portion and the gear housing.

9. The fuel pump of claim 8, wherein the chamfer and the funnel-shaped portion are configured to interface to limit insertion of the fuel pump adapter in the fuel pump aperture; and wherein a gap exists between the chamfer and the funnel-shaped portion when the body portion interfaces with the gear housing.

10. A fuel pump adapter for mounting a fuel pump, the fuel pump adapter comprising:

an outer surface formed to removably engage an inner circumference of a gear housing within a fuel pump aperture;

an inner surface defining a central aperture concentric to the outer surface, the inner surface formed to removably engage a pilot portion of the fuel pump and configured to facilitate rotation of the pilot portion relative to the outer surface within the central aperture; and a step protruding into the central aperture.

11. The fuel pump adapter of claim 10, wherein the step is configured to catch a leading edge of the pilot portion.

12. The fuel pump adapter of claim 10, wherein the outer surface defines a chamfer circumferentially disposed along the outer surface proximate the fuel pump.

13. The fuel pump adapter of claim 12, wherein the chamfer is configured to selectively interface with a funnel-shaped portion circumferentially disposed in the inner circumference of the gear housing, such that insertion of the fuel pump adapter in the gear housing is limited by the interface between the chamfer and the funnel-shaped portion.

14. The fuel pump adapter of claim 12, further comprising an O-ring circumferentially disposed along the outer surface in the chamfer, wherein the O-ring is configured to mitigate transfer of vibrational forces between the fuel pump and the gear housing.

15. The fuel pump adapter of claim 10, wherein the outer surface is defined by a first diameter; and wherein the first diameter is greater than a diameter of a fuel pump gear coupled to the fuel pump in the gear housing.

16. A fuel pump comprising:

a body portion housing a fuel pump assembly configured to generate fuel flows;

a drive shaft extending into the body portion and operatively coupled to the fuel pump assembly; and a pilot portion annularly disposed about the drive shaft adjacent to the body portion and configured to facilitate rotation of the drive shaft within the pilot portion, wherein the pilot portion is configured to removably receive a fuel pump adapter such that the fuel pump adapter remains substantially stationary during rotation of the drive shaft within the pilot portion, the fuel pump adapter being for engaging a gear housing;

wherein the body portion contacts the gear housing when the fuel pump adapter is received within the pilot portion and engaged with the gear housing;

wherein a circumferential edge of the pilot portion is configured to be received in a step of the fuel pump adapter.

17. The fuel pump of claim 16, wherein the circumferential edge is opposite the body portion.

18. The fuel pump of claim 16, wherein the body portion is configured to interface with the gear housing when the pilot portion receives the fuel pump adapter and when the pilot portion is coupled to a pump gear within the gear housing.

19. The fuel pump of claim 18, wherein the body portion does not interface with the fuel pump adapter.

20. The fuel pump adapter of claim 10, wherein the step is configured to facilitate rotation of the pilot portion within the central aperture.

* * * * *